US007392581B2

(12) United States Patent
Sano et al.

(10) Patent No.: US 7,392,581 B2
(45) Date of Patent: Jul. 1, 2008

(54) METHOD FOR MANUFACTURING A MAGNETIC ELEMENT

(75) Inventors: Kan Sano, Minamimizumoto Katsushika-ku (JP); Satoru Yamada, Nishikasai Edogawa-ku (JP)

(73) Assignee: Sumida Corporation, Tokyo (JP)

( * ) Notice: Subject to any disclaimer, the term of this patent is extended or adjusted under 35 U.S.C. 154(b) by 0 days.

(21) Appl. No.: 11/681,342

(22) Filed: Mar. 2, 2007

(65) Prior Publication Data

US 2007/0143985 A1 Jun. 28, 2007

Related U.S. Application Data

(62) Division of application No. 11/281,750, filed on Nov. 16, 2005, now Pat. No. 7,327,212.

(30) Foreign Application Priority Data

Nov. 16, 2004 (JP) ..... 2004-332302
Sep. 15, 2005 (JP) ..... 2005-268629

(51) Int. Cl.
*H01F 7/06* (2006.01)

(52) U.S. Cl. ..... 29/606; 29/605; 29/841; 29/855; 29/883; 29/884; 264/434; 310/263; 336/65; 336/67; 336/83; 336/192; 336/200; 439/510; 439/512; 439/516

(58) Field of Classification Search ..... 29/602.1, 29/605, 606, 841, 855–858, 883, 884; 100/214; 264/434; 310/263; 336/65, 67, 83, 192, 336/200; 439/510–512, 516, 579, 610
See application file for complete search history.

(56) References Cited

U.S. PATENT DOCUMENTS

| | | | | |
|---|---|---|---|---|
| 4,553,123 | A | 11/1985 | Tamada et al. | |
| 6,077,110 | A * | 6/2000 | Okabe et al. | 439/516 |
| 6,486,763 | B1 | 11/2002 | Kummel | |
| 6,504,463 | B1 * | 1/2003 | Kato et al. | 336/83 |
| 6,617,948 | B2 * | 9/2003 | Kuroshima et al. | 336/83 |
| 6,639,500 | B2 | 10/2003 | Makino et al. | |
| 6,922,130 | B2 * | 7/2005 | Okamoto | 336/208 |
| 2003/0052767 | A1 * | 3/2003 | Yamanobe et al. | 336/232 |
| 2003/0141952 | A1 | 7/2003 | Moro et al. | |
| 2004/0046626 | A1 | 3/2004 | Nakata et al. | |

FOREIGN PATENT DOCUMENTS

| | | | |
|---|---|---|---|
| JP | 60-043805 | | 3/1985 |
| JP | 02163906 | A * | 6/1990 |
| JP | 2002-203731 | | 7/2002 |
| JP | 2002319517 | A * | 10/2002 |

* cited by examiner

*Primary Examiner*—Paul D Kim
(74) *Attorney, Agent, or Firm*—Reed Smith LLP

(57) ABSTRACT

A plate member includes a frame portion (51) provided in a state of coupling both one end portion and other end portion and mounting terminal portions (44) protruding from the one end portion and the other end portion of said frame portion (51) to approach each other, from which a PCB joint portions (46) to be a mounting portion to a PCB are formed by cutting and bending when manufacturing a magnetic element. Further, a winding number adjustment means (41), which is capable of selecting joint portions with ends of a coil and adjusting the winding number of the coil in accordance with the selection, protrudes from the one end portion and the other end portion to approach each other farther as compared to the mounting terminal portions (44).

1 Claim, 7 Drawing Sheets

METHOD FOR MANUFACTURING A MAGNETIC ELEMENT

CROSS-REFERENCE TO RELATED APPLICATIONS

This application is a divisional application of U.S. application Ser. No. 11/281,750 filed Nov. 16, 2005 now U.S. Pat. No. 7,327,212 which claims priority of Japanese Application No. 2004-332302 filed Nov. 16, 2004 and Japanese Application No. 2005-268629 filed Sep. 15, 2005, the entire disclosures of which are hereby incorporated by reference.

BACKGROUND OF THE INVENTION

1. Field of the Invention

The present invention relates to a magnetic element used for various electric products such as a power supply section of a computer, and particularly to a plate member to form the magnetic element, the magnetic element using the plate member, and a manufacturing method of the magnetic element.

2. Description of the Related Art

Among magnetic elements such as an inductor, there exists one formed by press-molding and subsequently thermosetting a paste being a mixture of magnetic powders, resin, and the like. The magnetic element of such a type is formed to have the same shape as of a hollow section (cavity) formed by facing a core and a drag to each other. As an example magnetic element of this type, there is one disclosed in Japanese Patent Application Laid-Open No. 2002-203731 (refer to FIGS. 3 and 4, Paragraph No. 0027 and so forth) (hereinafter "Patent document 1").

According to the art disclosed in Patent document 1, in order to manufacture a magnetic element, first, a paste having a high-hardness portion and a low-hardness portion is formed. The high-hardness portion is provided on a rear surface portion of the paste and the low-hardness portion is provided on an upper surface side while it is adjacent to the rear surface portion. The low-hardness portion includes an outer leg portion and a middle leg portion. The paste is disposed inside a mold, and an exterior section is constituted by a press-molding of the paste in which the middle leg portion and outer leg portion are collapsed.

In the magnetic element manufacturing method disclosed in Patent document 1, no description is given as of an electric terminal to which an end of a winding wire is connected, therefore, here, a supplemental description will be given for the parts on the basis of the conventional arts. In order to form the terminal, a plate member provided with a frame portion and a protruding portion inwardly protruding from the frame portion is fabricated by die-cutting a metal plate. Then, powder pressing of a paste (granulated powders) is performed while the protruding portion is still with the frame member and, after that, the protruding portion is cut from the plate member. With these steps, in the course of manufacturing the magnetic element, it is possible to ensure to hold/position the terminal with respect to the magnetic element.

Meanwhile, a case where a change is made to an inductance value of the magnetic element upon a client request or so forth can be seen frequently. In that case, what needed to do is simply to change a winding number of a coil of the magnetic element. However, in the case of the magnetic element disclosed in Patent document 1 above, when changing the winding number of the coil, the shape of the mold to fabricate the terminal composing the magnetic element should be changed together. In other words, when changing the winding number of the coil, sometimes, there arises a case where the setting position of the terminal connecting the end of the winding wire should be changed together. In that case, the position of the protruding portion with respect to the frame portion is changed, so that the shape of the mold to fabricate the plate member should be changed together.

Here, as in the configuration disclosed in Patent document 1, when a round wire is adopted as a winding wire composing the coil, fluctuation in the inductance value for a tern is small, so that, in many cases, the change of the setting position of the terminal is not required. However, in recent years, along with demands for downsizing the magnetic elements, an approach, in which heat generation is suppressed by lowering resistance on the back of larger electric current, is increasingly adopted. In order to meet these demands, in the magnetic elements, a flat wire is used and a configuration, in which the winding number of the flat wire is small, is adopted, in many cases. In the configuration, the winding number is small, so that the fluctuation in the inductance value for a tern of the winding wire increases. In the magnetic element of such a configuration, when changing the inductance value, the positional relationship of a pair of ends of the coil changes frequently, and, in that case, the setting position change is required for the terminal together.

However, as described above, in the case where the plate member having the terminal is fabricated by die-cutting the metal plate, a change of the setting position of the terminal requires a shape change of the mold for the die-cut together. However, the change of the mold to form the plate member for each case in response to each customer request increases the production cost of the magnetic elements, being a problem.

SUMMARY OF THE INVENTION

The present invention has been made based on the above-described circumstances, and an object thereof is to provide a plate member requiring no shape change of a mold for die-cutting a metal plate for each winding number change even when the winding number is changed, a magnetic element using the plate member and a manufacturing method of the magnetic member.

In order to bring a solution to the above described problems, the present invention is a plate member including: a frame portion provided in a state of coupling both one end portion and other end portion; mounting terminal portions protruding from the one end portion and the other end portion of said frame portion to approach each other, from which a substrate joint portion to be a mounting portion to a substrate are formed by cutting and bending when manufacturing a magnetic element; and a winding number adjustment means protruding from an end portion and an other end portion to approach each other farther as compared to said mounting terminal portions and capable of selecting joint portions with ends of a coil, said winding number adjustment means adjusting the winding number of the coil in accordance with the selection.

When it is configured as in the above described manner, the mounting terminal portions protrude from the one end portion and the other end portion of the frame portion to approach each other. Here, the mounting terminal portion has the substrate joint portion which is formed by cutting and bending when manufacturing the magnetic element. Therefore, the magnetic element is mounted to the substrate by being jointed via the substrate joint portion. Further, from the respective mounting terminal portions, the winding number adjustment means protrudes to approach each other. Therefore, when the winding number adjustment means selects the joint portions of the ends of the coil, the winding number of the coil can be adjusted variously.

Therefore, it is not required to fabricate various plate members in accordance with the joint positions of the ends of the coil for each winding number of coil. With this, it is not required to fabricate the molds for pressing corresponding to the shapes of the plate members, so that the mold fabrication cost can be reduced. Further, with the use of the plate member according to the present invention, the winding number of the coil can be adjusted easily, so that the property change of the magnetic element can be made easily.

Further, another invention is, in addition to the above-described invention, the winding number adjustment means includes plural inner terminal portions and at least one of the plural inner terminal portions is provided with an extending portion extending in a direction orthogonal to a flat surface on which a flat plate portion of the frame portion exists, and in which the inner terminal portion provided with the extending portion is disposed at a different position from those of the other inner terminal portions in view of a normal direction of the flat plate portion of the frame portion due to the existence of the extending portion.

When it is configured as in the above described manner, it is easily possible to connect the one end and the other end of the coil which have different heights each other in the normal direction to the inner terminal portions positioning at different heights easily.

Still another invention is, in addition to the above-described invention, there exist four inner terminal portions and the four inner terminal portions are provided at intervals of an angle of 90 degrees when viewing from the normal direction of the flat plate portion of said frame portion as a plan view. When it is configured as in this manner, the four inner terminal portions are disposed to respectively have an interval of an angle of 90 degrees each other viewing from the normal direction as the plan view, so that the coil 30 can adjust its winding number by 0.25 turn, allowing a minute adjustment of the inductance value.

Still another invention is, a magnetic element including: a plate member described in the above; a core composed of a magnetic material and a thermosetting resin and including therein a winding number adjustment means, out of the plate member; and a coil included inside the core and ends thereof are jointed with the winding number adjustment means, in which a mounting terminal portion follows an end surface of the core and is provided from the end surface to a mounting portion of the core to be mounted to a PCB (Printed Circuit Board), and in which the winding number adjustment means includes plural inner terminal portions and is enabled to adjust a winding number of the coil by selecting any one of the plural inner terminal portions.

When it is configured as in the above described manner, out of the plural terminal joint portions provided in the winding number adjustment means, those terminal joint portions having positional relationships corresponding to the ends in accordance with the winding number of coil are jointed. The winding number adjustment means is included inside the core. With this, it is not required to fabricate the plate members of various shapes in accordance with the joint positions of the ends of the coil. Therefore, it is not required to fabricate the molds for pressing corresponding to the shapes of the plate members, so that the mold fabrication cost can be reduced. Further, the winding number of coil can be changed easily, and the property change of the magnetic element can be made easily as well.

Further, still another invention is, in addition to the above-described invention, the coil is composed of a flat wire, and the two ends existing in the coil are connected to such sides of the inner terminal portion that face each other, respectively.

When it is configured as in the above described manner, the ends of the coil facing each other are jointed with the inner terminal portions at the sides of the ends that do not face each other, respectively, while the end and the inner terminal portion are in the state of being overlapped each other. Therefore, the inner terminal portion is disposed so as not to protrude toward a not-facing side, so that the thickness of the magnetic element can be reduced while ensuring the winding number of the coil. Further, when such a jointing method is adopted, when the magnetic elements have the same height, the magnetic element according to the present invention can have a larger inductance value as compared to the conventional magnetic element. Similarly, the magnetic elements have the same height as well as the same winding number of the coil, the magnetic element according to the present invention allows a higher winding wire as compared to the conventional magnetic elements. Backed by this, the cross-section of the winding wire can be increased, so that the impedance of the magnetic element can be reduced.

Further, the higher the density of the core is, the above-described inductance value increases, however, when the above-described joint method is adopted and the magnetic elements are allowed to have the same height and inductance value, it is possible to reduce the pressing pressure at the press molding as compared to the conventional magnetic elements. Backed by this, the operation life of the mold used in the press molding can be extended. In addition, since the pressing pressure can be reduced, the broken ratio of an insulating layer existing at the periphery of the particles composing the core due to the pressing pressure can be reduced. Backed by this, since the pressing pressure can be reduced, it is possible to reduce the ratio of the insulating layer that is at the periphery of the particles composing the core and broken by the pressure. With this, an insulation resistance in the magnetic element can be increased.

Further, still another invention is a magnetic element manufacturing method including the steps of: die-cutting a metal member of a plate shape to form a plate member including a frame portion, a mounting terminal portion and plural terminal joint portions and having a winding number adjustment means capable of selecting a joint position of an end from the plural terminal joint portions in accordance with the winding number of the coil, winding a flat wire to form the coil of which ends are jointed with the terminal joint portions; setting the coil formed by said winding step while the terminal joint portions and the ends are in a contacting state; jointing the ends and the terminal joint portions to secure a positional relationship of the ends and the terminal joint portions; powder pressing to press the coils, the terminal joint portions and granulated powders while the coils and the terminal joint portions are coated with the granulated powders composed of a magnetic material and a thermosetting resin to thereby form a green compact in which the mounting terminal portion is in an exposed state by the pressing; heating the green compact formed by said powder pressing step to thermoset the granulated powders; and forming a terminal to form a PCB joint portion to be jointed with an external PCB by cutting the mounting terminal portion after said heating step at a middle portion of the mounting terminal portion and bending the cut mounting terminal portion.

When it is configured as in the above described manner, in the die-cutting step, the plate member, in which the winding number adjustment means having the frame portion, the mounting terminal portion and the terminal joint portion is provided, is formed from the metal member of the plate shape. Further, in the die-cutting step, the plate member having the winding number adjustment means is formed. Further, in the winding step, the coil is formed by winding the flat winding wire. Further, in the setting step, the wound coil is set in the state in which the terminal joint portions and ends contact. Further, in the jointing step, the contacting terminal joint portions and ends are jointed to secure their positional relationship. Further, in the powder pressing step, after the jointing step, the coil, the terminal joint portions and the granulated powders are pressed while they are in the state of being coated with the granulated powders. Then, in the heating step, the green compact formed in the powder pressing step is heated to thermoset the granulated powders. Furthermore, in the terminal forming step, the mounting terminal portions after the heating step are cut at their middle portions, and the mounting terminal portions are bent to form the PCB joint portions to joint with the external PCB.

The magnetic element formed through such respective steps does not require the plate members of various shapes in accordance with the joint positions or the like of the ends of the coil. With this, it is not required to fabricate the molds for pressing in accordance with the shapes of the plate members, so that the mold fabrication cost can be reduced. Further, the winding number of the coil can be adjusted easily, and the property change of the magnetic element can be made easily as well.

DETAILED DESCRIPTION OF THE PREFERRED EMBODIMENT(S)

Figure 1:
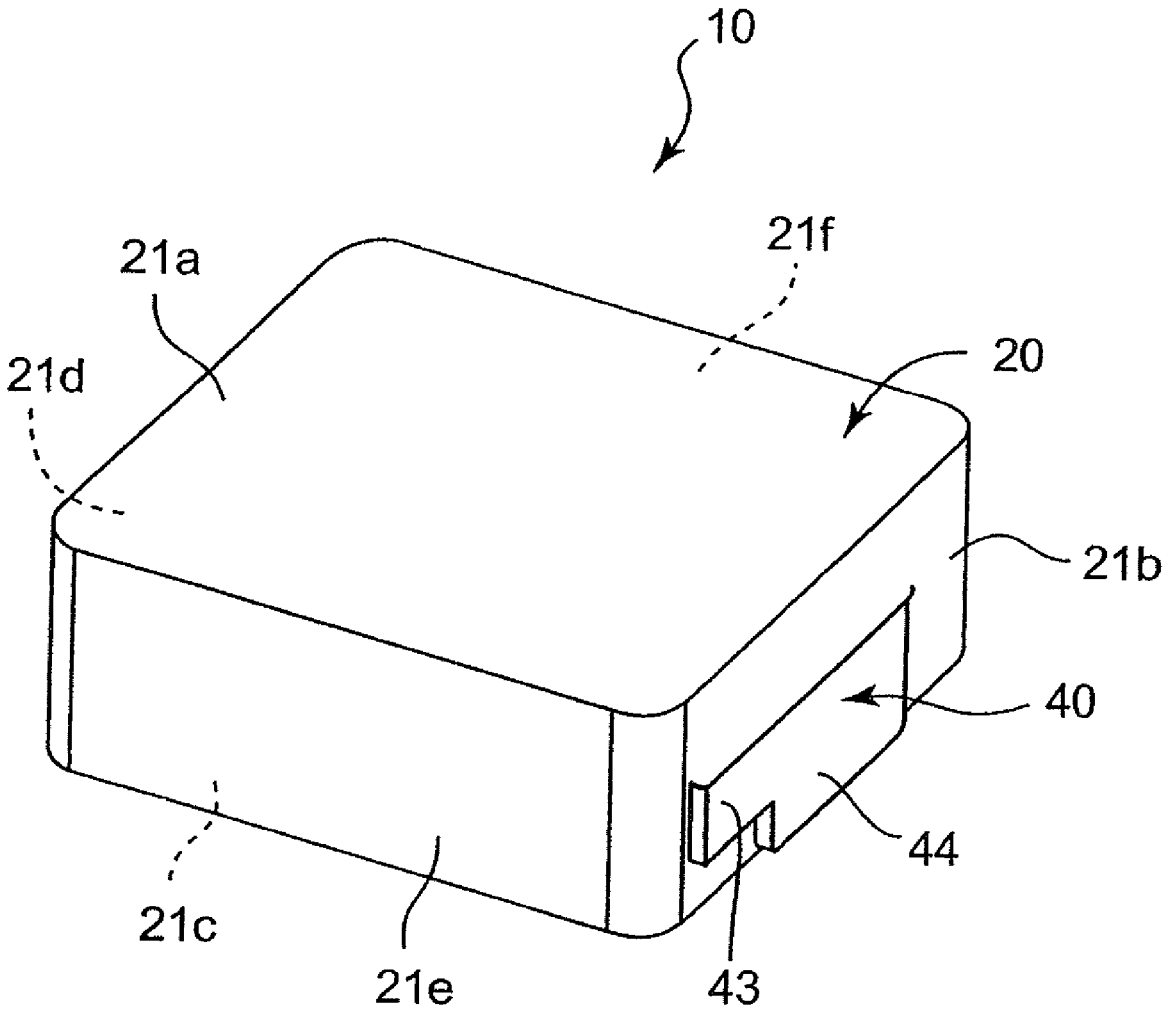
FIG. 1 is a perspective view showing an entire configuration of a magnetic element according to an embodiment of the present invention.
Figure 2:
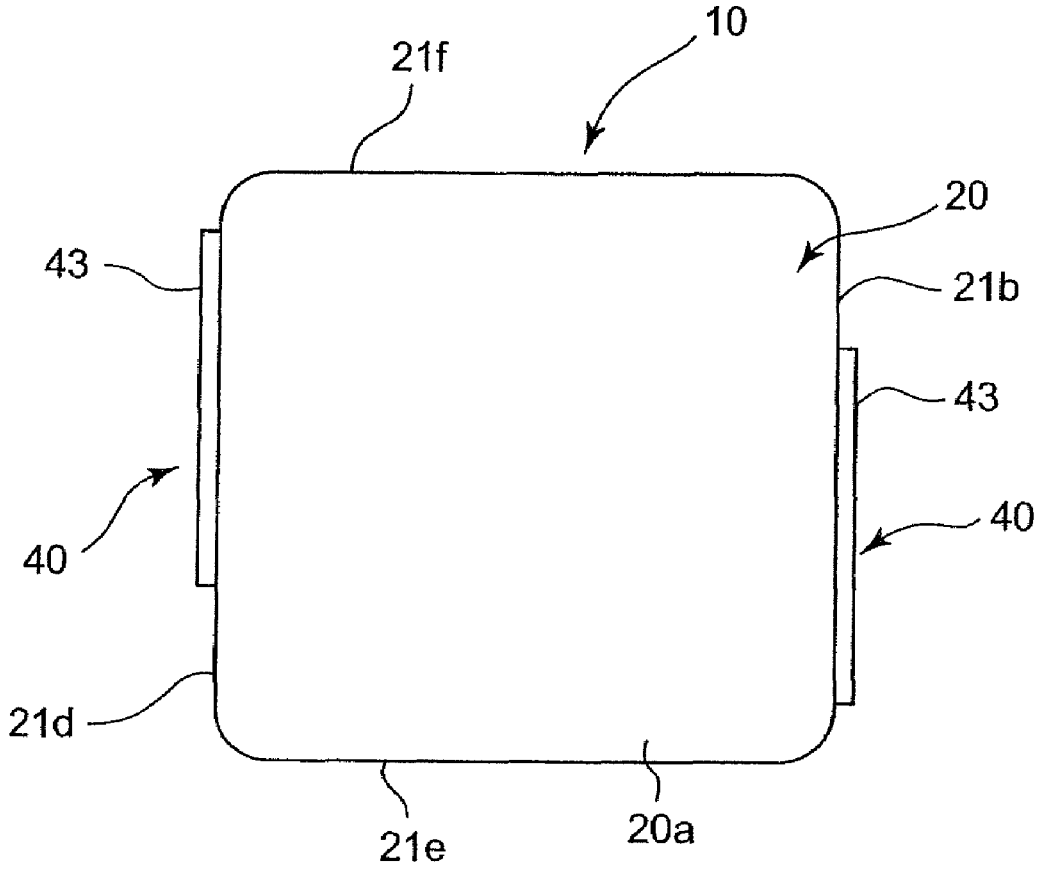
FIG. 2 is a plan view showing a state of the magnetic element in FIG. 1 by viewing from the above.
Figure 3:
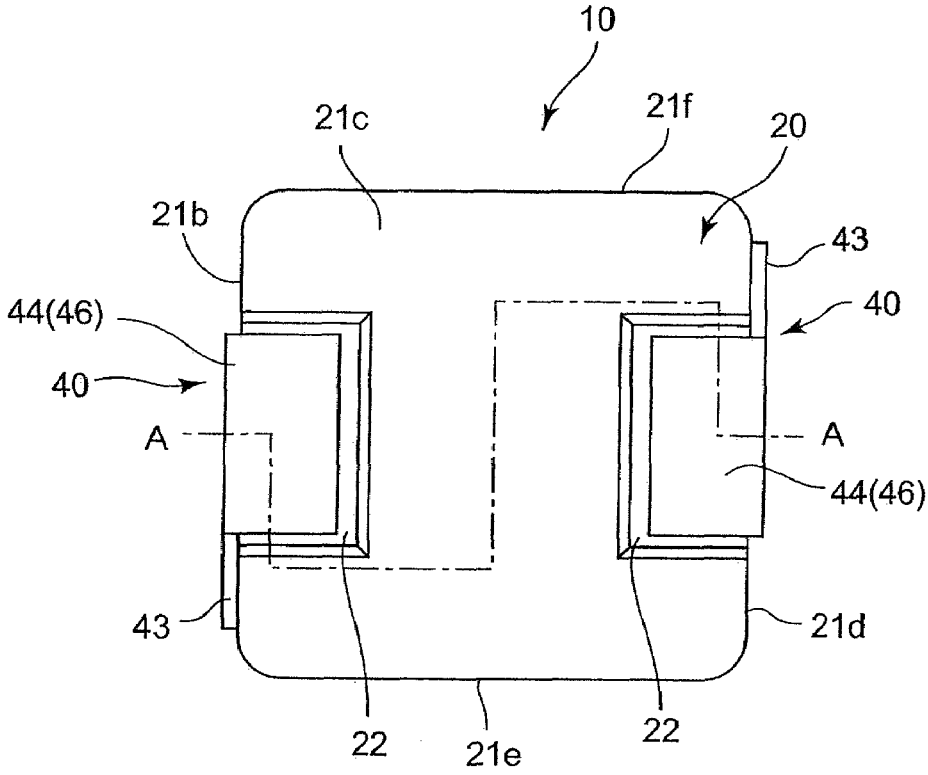
FIG. 3 is a plan view showing the state of the magnetic element in FIG. 1 by viewing from the below.
Figure 4:
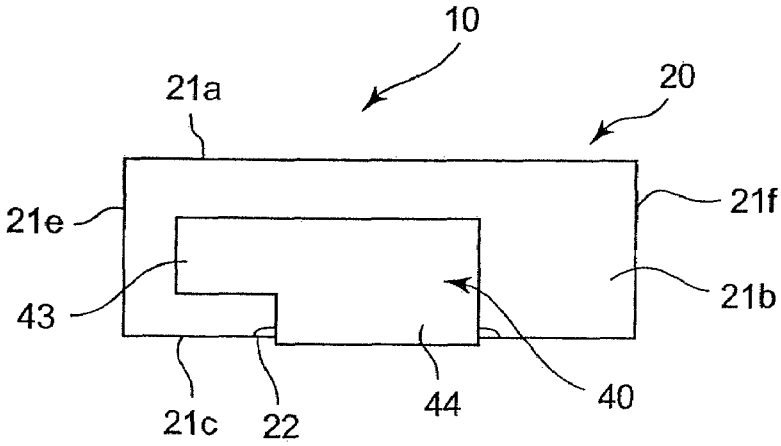
FIG. 4 is a front view showing a configuration of the magnetic element in FIG. 1.

Hereinafter, a description will be given of a magnetic element 10 according to an embodiment of the present invention based on FIGS. 1 to 10. FIG. 1 is a perspective view showing an entire configuration of the magnetic element 10. FIG. 2 is a plan view showing a state of the magnetic element 10 viewing from the above (an upper surface 21*a*). FIG. 3 is a bottom view showing the state of the magnetic element 10 viewing from a bottom surface (a lower surface 21*c*). FIG. 4 is a front view showing the state of the magnetic element 10 viewing from the front. Further, FIG. 5 is a sectional side view taken along an A-A line in FIG. 3 and showing a configuration of the magnetic element 10.

Note that, in the description below, of the magnetic element 10, an upper side indicates the upper surface 21*a* side being distant from the later-described lower surface 21*c*, and a lower side indicates the side on which later described recessed portions 22 for terminal are provided. Also, a height direction indicates a vertical direction connecting the upper surface 21*a* and the lower surface 21*c* in the magnetic element 10.

Figure 5:
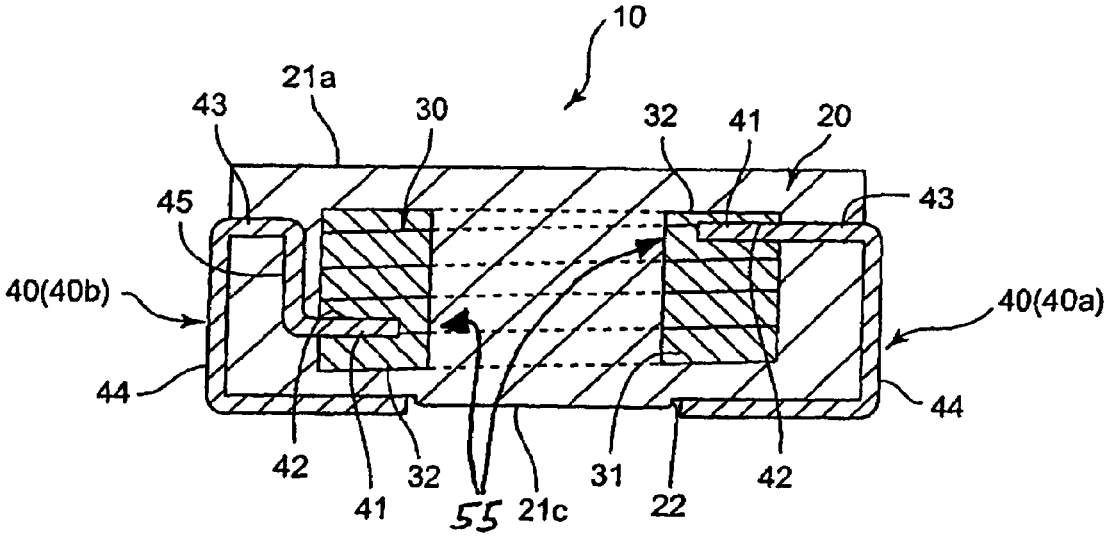
FIG. 5 is a sectional view showing the configuration of the magnetic element in FIG. 1 and taken along an A-A line in FIG. 3.

The magnetic element 10 according to the present embodiment includes a core 20, a coil 30, and terminals 40, as shown in FIG. 5 and so on. Out of these, the core 20 is composed of a soft magnetic material. As an example of such a soft magnetic material, there are, iron group materials and Mn—Zn ferrite, however, in addition to that, a variety of magnetic materials such as Ni—Zn ferrite, sendust (Fe—Si—Al; iron-silicon-aluminum), permalloy (Fe—Ni), Fe—Si—Cr can be used as the material of the core 20. Note that, in the present embodiment, the core 20 is made of granulated powders being a mixture of these magnetic materials and resin materials such as epoxy resin, as the material.

Further, as shown in FIGS. 1 to 4, the core 20 has substantially a rectangular parallelepiped shape in appearance. In detail, among the six outer surfaces 21 of the core 20 constituting the substantially rectangular parallelepiped shape, an outer surface (the outer surface positioning at the upper side in FIG. 1, which is defined as the upper surface 21*a* in the description below) directly facing a (not shown) mounting PCB and the lower surface 21*c* in parallel therewith are designed to have the largest surface area, respectively. Note that, in the description below, the six outer surfaces 21 include, in addition to the upper surface 21*a* and lower surface 21*c*, end surfaces 21*b*, 21*d* each having a pair of terminals 40 extending therefrom and side surfaces 21*e*, 21*d* provided orthogonally to these end surfaces 21*b*, 21*d* and upper surfaces 21*a*, 21*c*. When describing these plural outer surfaces 21, the upper surface 21*a*, end surface 21*b*, lower surface 21*c*, end surface 21*d*, side surface 21*e*, and side surface 21*f* will be also described as the outer surfaces 21*a* to 21*f*, respectively.

Further, the recessed portions 22 for terminal are provided on the lower surface 21*c* of the core 20. The recessed portions 22 for terminal are formed by such portions of the lower surface 21*c* that are adjacent to the end surface 21*b*, 21*d* and depressed from about a laterally center portion of the lower surface 21*c* to laterally outward of the lower surface 21*c*. In this case, the recessed portions 22 for terminal are formed such that they are in the state of going through the lower surface 21*c* toward the adjacent end surfaces 21*b*, 21*b*, respectively. Therefore, later-described mounting terminals 44 are allowed to enter into the recessed portions 22 for terminal.

Further, as shown in FIG. 5, the later-described coil 30 is provided inside the core 20. The outer periphery of the coil 30 is surrounded by the soft magnetic material composing the core 20. Therefore, in the core 20 in the present embodiment, the soft magnetic material is configured to enter into through holes positioning at the center portions of the coil 30. Note that parts of the later-described terminals 40 also enter into inside the core 20 in addition to the coil 30. The terminals 40 extend from the end surfaces 21*b*, 21*d* toward ends 32 of the coil 30, respectively. Inside the core 20, the ends 32 of the coil 30 and the terminals 40 (end joint portions 42) are jointed, for example, by laser welding, resistance welding, or the like.

Figure 6:
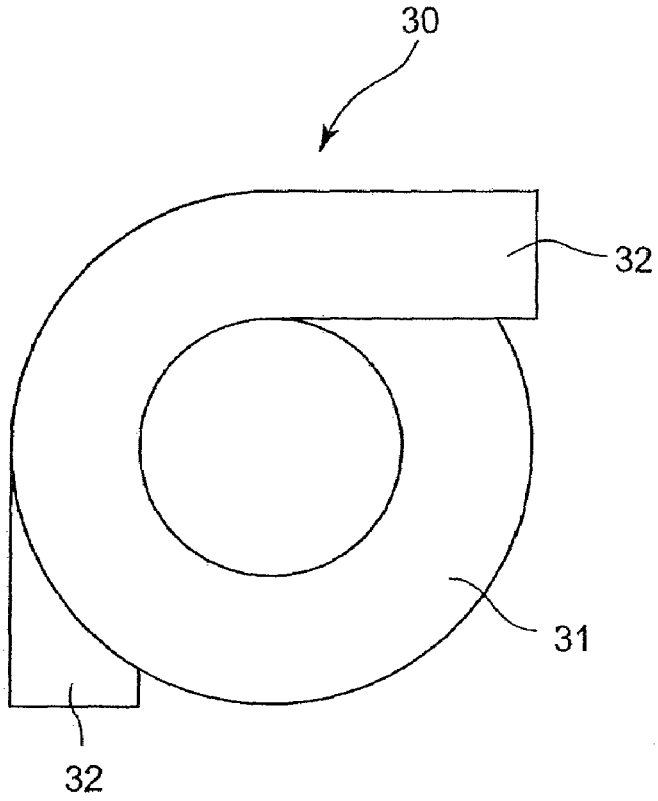
FIG. 6 is a plan view showing a shape of a coil composing the magnetic element in FIG. 1.
Figure 7:
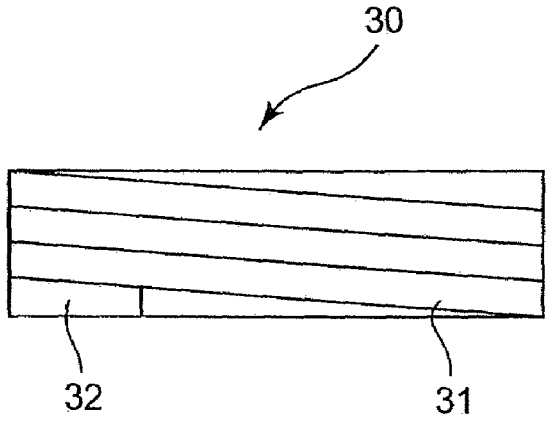
FIG. 7 is a side view showing the shape of the coil composing the magnetic element in FIG. 1.

Further, as shown in FIGS. 6 and 7, the coil 30 disposed inside the core 20 is composed of the winding wire of a flat wire 31. The flat wire 31 is a wiring wire having a substantially flat section and formed by coating the periphery, for example, of a copper material with an insulating film. The coil 30 is constituted by winding the flat wire 31 predetermined winding number of times. For reference, as to the winding number of times, there exists the coil wound about three to five times. As will be described later, in the present embodiment, the winding number of the coil 30 can be changed from the three to five times, provided that it is within a predetermined range.

Note that the winding number of times of the coil 30 is not limited to about three to five times, and various number of times are allowed.

Further, the terminals 40 to which the ends 32 of the coil 30 are connected, respectively, have a configuration slightly different to each other. Of the two terminals, a terminal 40*a* of one side includes an inner terminal portion 41 having an end joint portion 42 to be jointed with the end 32, a wide portion 43 continued from the inner terminal portion 41, a mounting terminal portion 44 continued from the wide portion 43 and having a mounting portion to be mounted to the mounting PCB, as shown in FIG. 5. Meanwhile, a terminal 40*b* of the other side has a downward extending portion 45 (corresponding to an extending portion) continued from the inner terminal portion 41 as well as the wide portion 43, in addition to the above.

Of these, the inner terminal portions 41 corresponds to a winding number adjustment means and are portions protruding from the end surfaces 21*b*, 21*d* toward the inside of the core 20, respectively. The shape of the inner terminal portion 41 at the wide portion 43 side is substantially a rectangular shape in appearance, while that at the joint side jointing with the end 32 is substantially a triangle in appearance. In this case, this substantial triangle at the joint side is provided in a manner that the side near the side surface 21*e* or 21*d* is designed to share the same surface as of the substantially rectangular portion of the inner terminal portion 41, and the side distant from the side surface 21*e* or 21*d* has a tilting surface. The ends 32 of the coil 30 are jointed to the inner terminal portions 41 (end joint portions 42) in a state of overlapping each other.

Note that, in the present embodiment, the inner terminal portions 41 (end joint portions 42) and the ends 32 are jointed with each other primarily at the substantial triangle portion. Further, in the joint, with a lazar beam irradiated from a lazar welding device as an example, a local temperature increase occurs to thereby melt the inner terminal portions 41 (end joint portions 42) as well as the winding wires of the ends 32. With this, the inner terminal portions 41 (end joint portions 42) and the ends 32 are jointed. Further, in the present embodiment, the inner terminal portions 41 and the ends 32 are jointed such that a lower surface of the end 32 positioning at an upper side and an upper surface of the inner terminal portion 41 positioning at the upper side are jointed while they are in an overlapping state, and a upper surface of the end 32 positioning at a lower side and a lower surface of the inner terminal portion 41 positioning at the lower side are jointed while they are in an overlapping state.

Further, the wide portions 43 are designed to be wider than the above-described inner terminal portions 41. The wide portions 43 are bent at its portion reaching to the end surfaces 21*b*, 21*d*. Specifically, of the wide portions 43, those portions at the inner terminal portions 41 side are in the states positioning inside the core 20, however, of the wide portions 43, those portions from the middle portions and leaving from the inner terminal portions 41 protrude from the inside of the core 20. The wide portions 43 protrude outward from the end surfaces 21*b*, 21*d* of the core 20 to be bent toward the lower surface 21*c* at the portions.

Further, the mounting terminal portions 44 are continued from the wide portions 43 on the end surfaces 21*b*, 21*d*. The mounting terminal portions 44 are designed to be narrower than the wide portions 43. Further, the mounting terminal portions 44 are positioned at about laterally center portions of the end surfaces 21*b*, 21*d*. The mounting terminal portions 44 are then extended to the lower ends of the end surfaces 21*b*, 21*d* to thereby be bent along the lower surface 21*c* from the lower ends.

Note that, of the mounting terminal portions 44, those portions bent along the above-described recessed portions 22 for terminal and positioning at the recessed portions 22 for terminal are defined as PCB joint portions 46. The PCB joint portions 46 are portions to be jointed with the mounting PCB via, for example, solder or the like.

Figure 8:
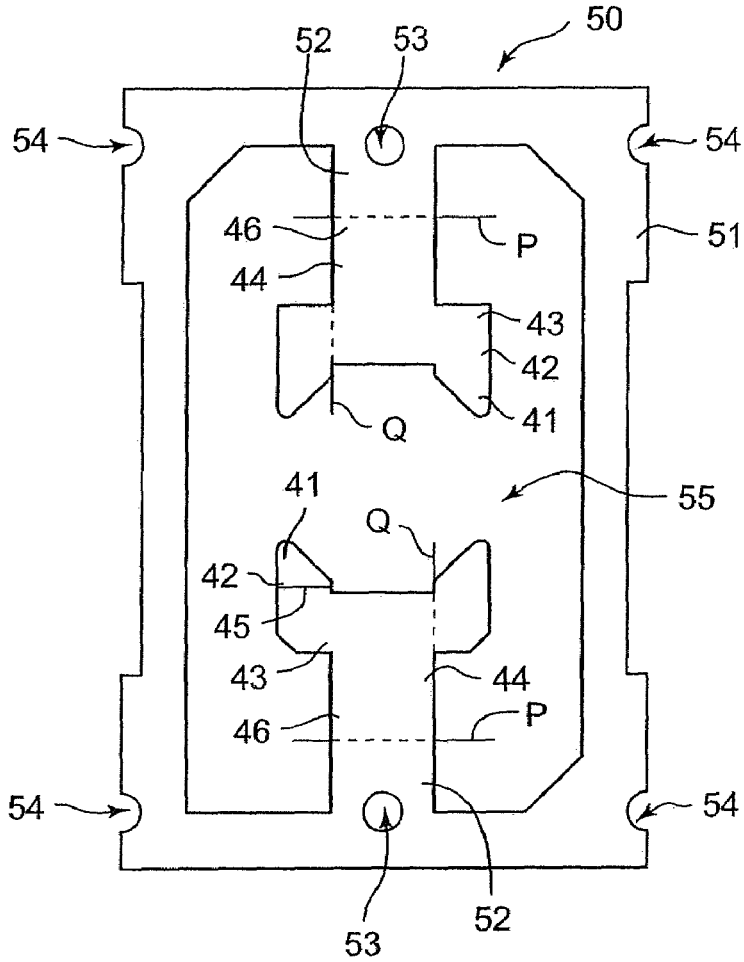
FIG. 8 is a plan view showing a shape of a plate member used to manufacture the magnetic element in FIG. 1.
Figure 9:
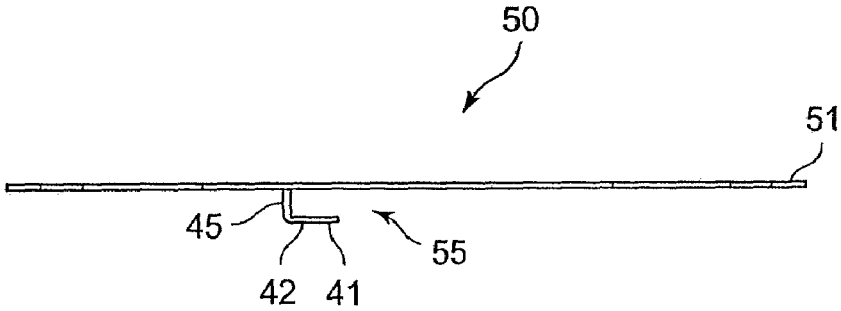
FIG. 9 is a side view showing the shape of the plate member used to manufacture the magnetic element in FIG. 1.

Subsequently, the description will be given of a plate member 50 to form the above-described terminals 40. As shown in FIGS. 8 and 9, the plate member 50 is designed to have substantially a rectangle outer frame. Additionally, the plate member 50 has a # shape being the substantially rectangle outer frame bored at its center portion. Note that, in the description below, the outer frame of the #-shaped plate member 50 is defined to be a frame portion 51.

At about laterally center portion of the frame portion 51, protruding portions 52 for terminal are provided along with the longitudinal direction of the frame portion 51. The protruding portions 52 for terminal are the portions to form the terminals 40 by being cut from the frame portion 51. Note that the protruding portion 52 for terminal is provided with respective portions composing the above-described terminal 40, and the respective portions will be described by denoting the same numerical references as of the respective portions of the terminal 40. Specifically, the protruding portion 52 for terminal includes the mounting terminal portion 44 extending toward a center side of the plate member 50 along the longitudinal direction of the frame portion 51, the wide portion 43 positioning at the center side from the mounting terminal portion 44 and designed to be wider than the mounting terminal portion 44, and the inner terminal portion 41 extending toward the center side of the plate member 50 from the end portion of the protruding side of the wide portion 43 further along the longitudinal direction.

Here, the inner terminal portion 41 on the other side is provided at a different height from the height of the inner terminal portion 41 of the one side. Therefore, the inner terminal portion 41 on the other side is provided with the above-described downward extending portion 45 that is continued from both the inner terminal portion 41 and the wide portion 43. In the present embodiment, the downward extending portion 45 is designed to be provided in advance to only one of the four inner terminal portions 41. The downward extending portion 45 and the respective inner terminal portions 41 to which the ends 32 are connected compose a coil setting portion 55 to set the coil 30.

Here, the downward extending portion 45 extends in the normal direction being orthogonal to a flat surface on which a flat plate portion of the frame portion 51 exists. Therefore, the inner terminal portion 41 having the downward extending portion 45 is provided at a different position from those of the other inner terminal portions 41 in view of the height direction (normal direction).

Of these, the mounting terminal portions 44 are portions to be cut along straight line Ps (see FIG. 8) of the midstream thereof and corresponding to the mounting terminal portions 44 by the cutting. Further, the wide portions 43 are portions corresponding to the previously-described wide portions 43.

Note that, in the above-described plate member 50, the four inner terminal portions 41 are disposed around the center portion of the plate member 50 to form an angle of about 90 degrees with respective to the neighboring one. Further, the inner terminal portions 41 are distant from each other to the extend of jointing with the ends 32, respectively. Note that the inner terminal portions 41 are provided to be distant from each other to the extent of the diameter of the coil 30. Further, out of the four inner terminal portions 41, any two inner terminal portions 41 not jointed with the ends 32 of the coil 30 may be cut along straight lines Q in FIG. 8. In addition, in the molding of the plate member 50, it is possible to mold the plate member 50 by inserting a panel in advance instead of the cutting.

Note that, when the magnetic element 10 is an inductor having an inductance value of 1 μH or below, for adjusting the inductance value, a configuration as described above in which the inner terminal portions 41 are disposed at intervals of an angle of 90 degrees (namely, for each 0.25 round) is extremely effective.

Further, positioning holes 53 are provided at root portions of the protruding portions 52 for terminal with respect to the frame portion 51. The positioning holes 53 are holes to determine a position when setting the plate member 50 to the mold. The protruding portions of the mold can be inserted into the positioning holes 53, so that the position of the plate member 50 with respect to the mold can be determined easily and accurately.

Note that, as shown in FIG. 8, in the plate member 50, cutout portions 54 are provided in addition to the positioning holes 53. It is also possible to position the plate member 50 with respect to the mold using these cutout portions 54.

Figure 10:
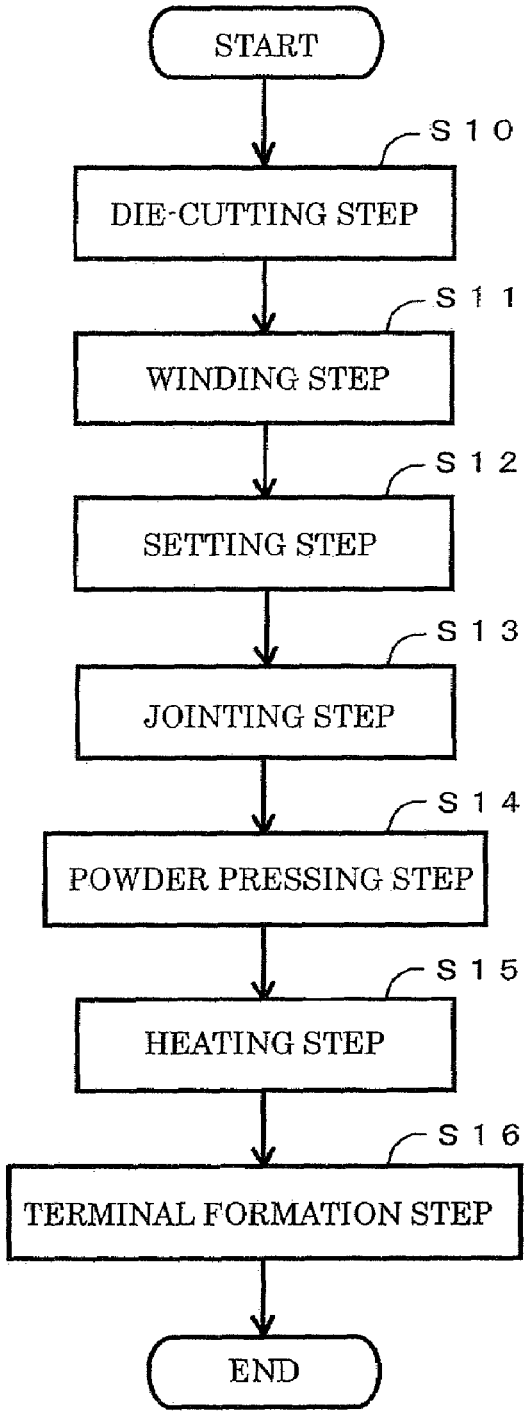
FIG. 10 is a flowchart showing a manufacturing method of the magnetic element in FIG. 1.

Hereinafter, a manufacturing method in the case of manufacturing the magnetic element 10 as of the above-described configuration by using the plate member 50 will be described based on FIG. 10.

First, before manufacturing the magnetic element 10, the plate member 50 is formed. In this case, the plate member 50 of the shape shown in FIGS. 8 and 9 are formed by die-cutting a thin plate member made of metal using, for example, a press manufacturing apparatus (Step S10: corresponds to a die-cutting step). In this case, unnecessary two inner terminal portions 41 in view of the joint are also left in addition to two necessary two inner terminal portions 41 in view of the joint. However, it is also possible to cut down the unnecessary inner terminal portions 41 (the inner terminal portions 41 to be cut down along the straight lines Q in FIG. 8) in view of the joint while leaving only the necessary inner terminal portions 41 in view of the joint. As an example case of performing such a cutting, a core corresponding to the cutting is inserted into inside the press manufacturing apparatus. In the press manufacturing apparatus, the die-cutting portion (punching portion) is extended to the extent of the core inserted, so that the unnecessary inner terminal portions 41 are cut as well. Further, the cutting may be performed not in the die-cutting step but in a later step, for example, by the lazar beam irradiation or the like.

Further, apart from the formation of the plate member 50, the coil 30 is formed by winding the flat wire 31 (Step S11: corresponds to a winding step). Note that this Step S11 may be performed before the above-described Step S10.

Next, the coil 30 is set at the coil setting portion 55 of the plate member 50 (Step S12: a setting step). In this case, the setting is performed such that the ends 32 overlap the inner terminal portion 41 on one side and the inner terminal portion 41 on the other side, respectively. At this time, as shown in FIG. 5, the joints of the ends 32 with the inner terminal portions 41 are performed at mutually facing sides. Specifically, the lower surface of the end 32 positioning at the upper side and the upper surface of the inner terminal portion 41 positioning at the upper side are jointed by being overlapped to each other, and the upper surface of the end 32 positioning at the lower side and the lower surface of the inner terminal portion 41 positioning at the lower side are jointed by being overlapped to each other.

Subsequently, the joints of the ends 32 and the inner terminal portions 41 are performed (Step S13: corresponds to a joint step). In this case, the lazar beam is irradiated from the end 32 side or the inner terminal portion 41 side using the lazar welding device. With this, the temperature of the portion to which the lazar beam is irradiated locally shows an increase to thereby locally melt the end 32 or the inner terminal portion 41, so that they are jointed. In other words, a lazar welding is established between the end 32 and the inner terminal portion 41.

Note that the welding between the end 32 and the inner terminal portion 41 is not limited to the lazar welding, and the joint of the end 32 and the inner terminal portion 41 may be performed by other methods such as soldering.

After implementing such a welding, the plate member 50 and the coil 30 are set inside the mold, and predetermined amounts of granulated powders are set as well so that the plate member 50 and the coil 30 are placed in the state of coated with the granulated powders. In this case, the plate member 50 is placed in the state of being held/positioned and secured by fitting the positioning holes 53 to the protruding portions existing at an edge portion of the mold or the like. In this state, the cope and the drag of the mold are driven to a mutually approaching direction, and a press operation is implemented (Step S14: corresponds to a powder pressing step). As a result, a green compact being a runup (phase before the sintering) of the magnetic element 10 is formed.

Subsequently, a heat treatment is performed to the green compact formed. Specifically, by heating the green compact, the granulated powders are thermoset (Step S15: corresponds to a heating step). After such a heat setting, the protruding portions 52 for terminal are cut along the straight lines P (Step S16: a terminal formation step). With this, the green compact after the heating is placed in the state of being cut from the plate member 50.

Subsequently, the wide portions 43 and mounting terminal portions 44 are bent. Specifically, the wide portions 43 and mounting terminal portions 44 are bent such that they follow the end surfaces, and at the same time, the tip portion sides of the mounting terminal portions 44 are placed in the state of inserting into the recessed portions 22 for terminal. Backed by this, the magnetic element 10 is completed. Note that, with such bendings, the PCB joint portions 46 of the mounting terminal portions 44 are placed in the state of protruding outward (downward) from the recessed i. portions 22 for terminal. With this, the mounting of ii. the magnetic element 10 is facilitated.

In addition, an example relationship between the winding numbers and inductance values (L) of the magnetic element 10 manufactured according to such a flow will be shown. In this case, based on an equation: $L=A_L \times T^2$ ($A_L=\mu_0 1S$), when the flat wire 31 is wound 3.25 rounds, the inductance value of the magnetic element 10 is 482 (nH), when the flat wire 31 is wound 3.5 rounds, the inductance value of the magnetic element 10 is 560 (nH), when the flat wire 31 is wound 3.75 rounds, the inductance value of the magnetic element 10 is 642 (nH).

According to the magnetic element 10 of such a configuration, it is not required to fabricate the plate members 50 of various shapes in accordance with the winding number of the coil 30. Specifically, even if the positional relationship between the ends 32 of the coil 30 is changed, it is possible to select the inner terminal portions 41 to joint the ends 32 in response to the change. Accordingly, it is not required to newly fabricate the mold for the die-cutting (press) in response to the shape change of the plate member 50 for each case, so that the mold fabrication cost can be reduced.

Further, an appropriate selection of the inner terminal portions 41 allows an easy change of the winding number, so that the property change of the magnetic element 10 can be made easily as well. Accordingly, it is possible to manufacture a variety of magnetic elements 10 of different properties at low cost. Above all, as in the present embodiment, when the plate member 50 is viewed from the above as a plan view, the four inner terminal portions 41 are positioned around the center portion of the plate member 50 at intervals of an angle of about 90 degrees with respect to the neighboring one. Therefore, the coil 30 is allowed adjusting its winding number by 0.25 round, so that the inductance value (L) can be adjusted minutely.

Further, according to the present embodiment, the coil 30 is formed by the flat wire 31. Therefore, the surface of the inner terminal portion 41 and the surface of the end 32 of the core 30 contact, allowing them to be jointed easily by the lazar welding or the like. Accordingly, the productivity of the magnetic element 10 can be improved further. Furthermore, in the present embodiment, the press molding (green molding) is performed by putting the granulated powders into inside the mold while the inner terminal portions 41 are still attached to the plate member 50. Therefore, the positioning of the terminals 40 with respect to the magnetic element 10 can be performed accurately, as compared to the case where the plate member 50 is disposed with its terminals 40 being cut.

In particular, as described above, when the positioning holes 53 and cutout portions 54 are in use, the positioning and holding of the plate member 50 with respect to the mold can be ensured further. Therefore, a positional displacement of the terminals 40 with respect to the core 20 can be prevented at high level of accuracy. With this, in the manufacturing process of the magnetic element 10, an incidence of defects can be reduced, so that the production cost can be reduced further.

Further, the core 20 is provided with the recessed portions 22 for terminal, and the depth of the recessed portion 22 for terminal is designed to be smaller than the thickness of the PCB joint portion 46. Therefore, the lower surface sides of the PCB joint portions 46 are placed in the state of slightly protruding from the recessed portions 22 for terminal, allowing an easy mounting to the PCB.

Further, the inner terminal portion 41 having the downward extending portion 45 is provided at the different position from that of the other inner terminal portions 41 in view of the height direction (normal direction). Accordingly, one end 32 and the other end 32, which are set at different height positions, can be connected to the inner terminal portions 41, with ease, respectively.

Further, as previously described, in the present embodiment, the lower surface of the end 32 positioning at the upper side and the upper surface of the inner terminal portion 41 positioning at the upper side, and the upper surface of the end 32 positioning at the lower side and the lower surface of the inner terminal portion 41 positioning at the lower side are jointed, respectively, while they are in the state of being overlapped with each other. Accordingly, the inner terminal portions 41 are disposed to protrude neither upward nor downward, so that the thickness of the magnetic element 10 can be reduced further while ensuring the winding number of the coil 30.

Additionally, when the above-described jointing method is adopted and when the magnetic elements have the same height, the magnetic element 10 according to the present embodiment can increase the inductance value (L) to larger as compared to conventional magnetic element. Similarly, when the magnetic elements have the same height and the coils have the same winding number, then the magnetic element 10 according to the present embodiment allow the flat wire to have a larger height as compared to the conventional magnetic elements. Backed by this, it is possible to increase the cross section of the flat wire 31, so that the impedance of the magnetic element 10 can be reduced.

Also, the higher the density of the core 20 is, the above-described inductance value (L) becomes larger. Here, when the above-described jointing method is adopted and the magnetic elements are allowed to have the same height and inductance value (L), the magnetic element 10 according to the present embodiment is enabled to reduce the pressing pressure at the time of the pressure molding, as compared to the conventional magnetic elements. Backed by this, the operating time of the mold used to perform the pressure molding can be extended. Besides, since the pressing pressure can be reduced, it is possible to reduce the ratio of the insulating layer that is at the periphery of the granulated powders and broken by the pressure. With this, an insulation resistance in the magnetic element 10 can be increased.

The description has been given of the magnetic element 10 according to an embodiment of the present invention in the above, however, the magnetic element 10 of the present invention is variously modifiable in addition to the above. Hereinafter, the description will be given of the modifications.

In the above-described embodiment, the terminals 40 are formed by being cut from the plate member 50 having the frame portion 51 of the frame shape. However, the plate member 50 is not limited to the configuration having the frame portion 51 of the frame shape. For instance, a configuration in which a coupling portion coupling the two terminals 40 in an open-sided manner is provided and the terminals 40 are cut from the coupling portion may be adopted.

Further, in the above-described embodiment, the description is given of the case where the coil 30 is formed using the flat wire 31 as a winding wire, however, the winding wire is not limited to the flat wire 31. For instance, as a winding wire, a round wire of a circular section may be used to form the coil.

Further, in the above-described embodiment, the four inner terminal portions 41 are provided in the description. However, the configuration of the plate member 50 is not limited to that having four inner terminal portions 41, and is allowed to have any number of inner terminal portions 41 provided that it is three or more. Note that when the plate member 50 is provided with eight inner terminal portions 41, as an example, the configuration in which the protruding portions 52 for terminal protrude in the longitudinal direction of the plate member 50 as well as in the lateral direction of the plate member 50 can be adopted. In this case, the total of eight inner terminal portions 41 exist on the back of the protruding portions 52 for terminal respectively provided with two inner terminal portions 41.

Further, in the above-described embodiment, the description is given of the magnetic element 10 having only a single piece of coil 30. However, the magnetic element can be configured to have two or more coils. Note that when the magnetic element has two or more coils 30, the number of terminals 40 also increases in accordance with the number of coils 30.

Further, the usage of the magnetic element 10 according to the present invention is not limited. For instance, when the magnetic element has a single coil 30, the magnetic element may be used as an inductor, a noise filter or the like. Also, when the magnetic element has two coils 30, the magnetic element may be used as a multiple inductor, a multiple noise filter, a common mode choke coil, a transformer or the like.

Further, in the above-described embodiment, the core 20 has substantially a rectangular parallelepiped shape in appearance. However, the shape of the core is not limited to the substantial rectangular parallelepiped shape, and various shapes can be adopted such as a substantial cylindrical shape. Also, in the above-described embodiment, the core 20 is configured to have no slit or the like as a magnetic gap in the description. However, the core 20 may be configured to have the slit as the magnetic gap.

Further, in the above-described embodiment, the terminals 40 are formed by cutting appropriate portions of the mounting terminal portions 44 from the plate member 50 after completing the heating step, however, the terminals may be cut from the plate member 50 beforehand, and the press molding may be performed using the cut terminals. Note that, in that case, the terminals cut beforehand are configured to have the winding number adjustment means.

The magnetic element according to the present invention may be utilized in the field of electric equipment.

What is claimed is:

1. A magnetic element manufacturing method comprising the steps of:

die-cutting a metal member of a plate shape to form a plate member including a frame portion, a mounting terminal portion and plural terminal joint portions and having a winding number adjustment means capable of selecting a joint position of an end from the plural terminal joint portions in accordance with a winding number of a coil;

winding a flat wire to form the coil of which ends are jointed with the terminal joint portions;

setting the coil formed by said winding step while the terminal joint portions and the ends are in a contacting state;

jointing the ends and the terminal joint portions to secure a positional relationship of the ends and the terminal joint portions;

powder pressing to press the coils, the terminal joint portions and granulated powders while the coils and the terminal joint portions are coated with the granulated powders composed of a magnetic material and a thermosetting resin to thereby form a green compact in which the mounting terminal portion is in an exposed state by the pressing;

heating the green compact formed by said powder pressing step to thermoset the granulated powders; and forming a terminal to form a PCB joint portion to be jointed with an external PCB by cutting the mounting terminal portion after said heating step at a middle portion of the mounting terminal portion and bending the cut mounting terminal portion.

* * * * *